United States Patent [19]

Chietti

[11] 4,196,681

[45] Apr. 8, 1980

[54] APPARATUS FOR LOADING TUBULAR ELEMENTS OF TEXTILE MATERIAL ON MOUNTING TUBES IN SEWING MACHINES

[76] Inventor: Giovanni Chietti, Via di Treggiaia 78, La Romola 20050 (Firenze), Italy

[21] Appl. No.: 5,900

[22] Filed: Jan. 23, 1979

[30] Foreign Application Priority Data

Jan. 27, 1978 [IT] Italy ..... 9326 A/78

[51] Int. Cl.[2] ..... D05B 21/00; A41H 43/00

[52] U.S. Cl. ..... 112/121.15; 223/42; 223/43

[58] Field of Search ..... 112/121.15, 121.12, 112/121.11; 223/39, 42, 43

[56] References Cited

U.S. PATENT DOCUMENTS

| | | | |
|---|---|---|---|
| 2,156,339 | 5/1939 | Horn | 223/42 |
| 2,905,366 | 9/1959 | Shoaf | 223/42 |
| 3,351,033 | 11/1967 | Kienel | 112/121.15 |
| 3,420,196 | 1/1969 | Edwards et al. | 112/121.15 |
| 3,500,779 | 3/1970 | Jones et al. | 112/121.15 |
| 3,520,262 | 7/1970 | Bolles et al. | 112/121.15 |
| 3,520,454 | 7/1970 | Saltiel | 112/121.15 |
| 3,738,294 | 6/1973 | Christiansen | 112/121.15 |
| 3,859,938 | 1/1975 | Fukuyama | 112/121.15 |
| 3,952,673 | 4/1976 | Fukuyama | 112/121.15 |
| 4,133,276 | 1/1979 | Selvi | 112/121.15 |

*Primary Examiner*—H. Hampton Hunter

*Attorney, Agent, or Firm*—Haseltine, Lake & Waters

[57] ABSTRACT

Apparatus comprising a plurality of shaped bodies carried on a rotable structure. On the end of each body one edge can be manually placed of a tubular element of textile material forming the leg of a stocking. During the rotation of said structure, each body having said element hanging therefrom, is positioned in front of and adjacent to the free end of a mounting tube in a semiautomatic sewing machine. At this position an elongated rod is automatically operated, such a rod being provided with a hook member separating the edge of the tubular element from the shaped body, overturning and transferring it onto the end of the pounting tube and causing it to slide along the tube, where it is caught by the gripping members the sewing machine is fitted with, the machine then providing for sewing the other end of the tubular element forming the tip of a stocking.

4 Claims, 7 Drawing Figures

APPARATUS FOR LOADING TUBULAR ELEMENTS OF TEXTILE MATERIAL ON MOUNTING TUBES IN SEWING MACHINES

This invention relates to an apparatus for loading tubular elements of fabric material, intended for stocking manufacture, on mounting tubes in semiautomatic sewing machines for sewing one end thereof to provide finished stockings.

It is known that in stocking manufacture tubular elements of fabric or textile material are used, one end of which may be reinforced or fitted with elastic fabrics, and the other end of which is sewn (with the tubular element overturned, that is while the surface intended to be the visible outside surface in the stocking is turned inwardly of the tubular element) by means of semiautomatic sewing machines.

Many types of such sewing machines are known, such as those disclosed in U.S. Pat. No. 3,859,938 and in the published German patent application No. 2,706,770, which are provided with a rotary turret having stocking mounting tubes projecting therefrom. A workman, who is in front of the free end of these tubes, time by time takes in his hands a tubular element of textile material (which is always the right side, that is with its outer surface that is intended to remain at the outside during the stocking wear or use), overturns it and places on it that end which is not to be sewn on the free end of that tube of the sewing machine which is in front of him. Then, still manually the workman causes the tubular element of textile material to slide along the mounting tube, until it is caught and drawn by mechanical members the machine is fitted with: at this position, with only one free end projecting from the mounting tube, the tubular element of textile material is automatically moved to under the sewing head of the machine, the latter providing for sewing the tip thereof, whereby a finished stocking is obtained. In order to facilitate and speed up the workman's job or work, and particularly to simplify the relative operation of overturning the tubular elements of textile material, in modern sewing machines the mounting tubes are internally hollow, and at the position at which the workman can place said tubular element thereon are connected to a suction pump. Thus, the workman holding in his hand that end of the tubular element which is not to be sewn, presents the other end in front of the open mouth or inlet of the mounting tube which is at loading position: thus, the other end and major portion of the tubular element of textile material is drawn within the hollow mounting tube, on the free end of which the workman can place, by outwardly overturning it, that end of the tubular element that he held in his hand.

The manual operation does not run out here, also because the tubular element could be separated from the tube end on which it is superimposed and be completely drawn within the tube, but he has to retain or hold the edge of the tubular element and cause to slide along the mounting tube until it is caught and drawn by the mechanical members that the sewing machine is provided with.

In order to reduce the production costs, there is the tendency to speed up the processing speed of the sewing machines, also increasing the of the mounting tubes that such machines are provided with. However, this increase in speed and production or output is materially inhibited in that the above mentioned workman is uncapable of following the rate of the sewing machine. It was found that the time required for completing the assembling of a tubular element of textile material on a mounting tube of a sewing machine is essentially established in that the workman has first to cause the stocking to be drawn within the mounting tube and then, after overturning that edge thereof that he held in his hand and placing it on the free end of the tube, he has to manually cause the tubular element to slide along the tube, until it is mechanically caught and drawn.

It is the primary object of the present invention to provide an apparatus by which the operations of correct loading of tubular elements of textile material on mounting tubes in sewing machines can be substantially simplified and speeded up.

It is another object of the invention to provide an apparatus of the above mentioned type, which is of a simple structure and reliable in use, and particularly readily connectable to any known type of sewing machine.

These and still further objects are accomplished by an apparatus for loading tubular elements of textile material on mounting tubes in semiautomatic sewing machines for sewing one end thereof to provide finished stockings, characterized by comprising a plurality of shaped bodies carried on a rotable structure and spaced apart from one another, said rotable structure having projecting from one face thereof one end of each body which on its outer surface has at least one groove parallel to the pivot pin of the rotable structure, in that said end of each body has a perimeter substantially as long as said end of the textile tubular elements, that juxtaposed to said structure a device is positioned as comprising an axially movable elongated rod, the free end of which at rest or inoperative position is clear of the path for the shaped bodies, the device including a control member causing an axial reciprocation of said rod bringing it to graze or touch lightly and go beyond the projecting end of that shaped body which time by time is at the zone in front of said rod, having its free end fast or integral with a hook or the like facing the projecting end of the shaped body which is at said zone, such a hook moving in said groove of the body as the rod moves.

In order that the structure and characteristics of an apparatus according to the invention be more clearly understood, a preferred embodiment of an apparatus of the invention will now be described by mere way of unrestrictive example with reference to the accompanying drawings, in which:

FIG. 4 is a perspective view of an end of an embodiment for one of the shaped bodies for the mounting of the tubular elements of textile material, which the apparatus is provided with;

Figure 1:
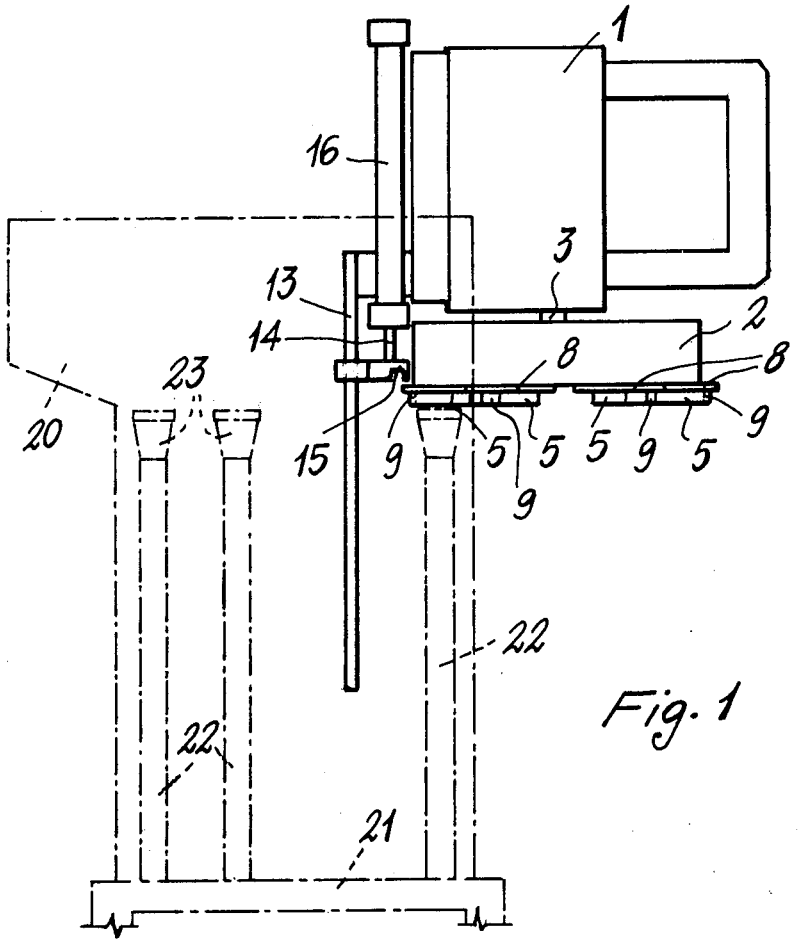
FIG. 1 is a plan diagrammatic view showing the apparatus located in front of a sewing machine, one portion of which dashed or sectioned.
Figure 2:
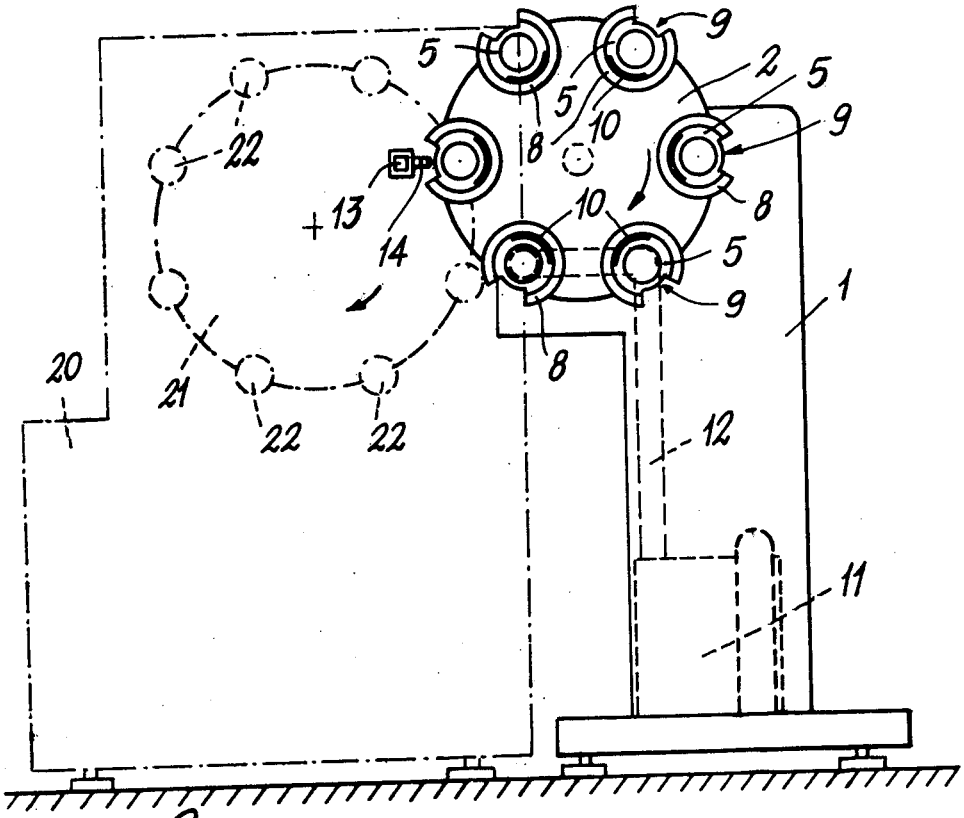
FIG. 2 is a front view of the apparatus, still showing one portion of the sewing machine as dashed or sectioned.
Figure 3:
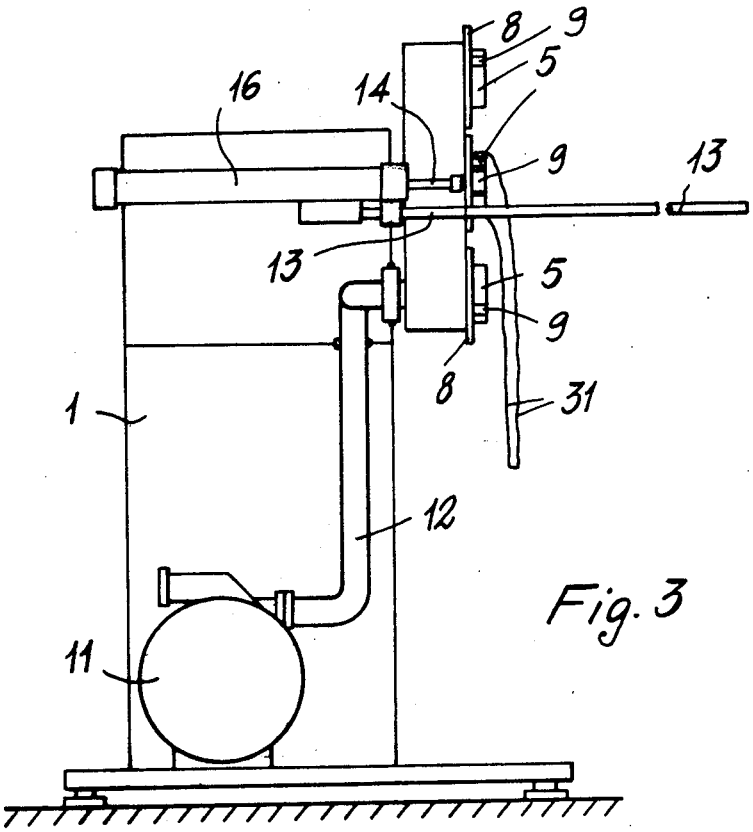
FIG. 3 is a diagrammatic side elevational view of the apparatus.

Referring first to FIGS. 1-3, in such figures an apparatus is diagrammatically shown as comprising a base 1, on which a rotatable structure is mounted, including (in the embodiment shown) a disc 2 carried by a rotable shaft 3 (FIG. 1). This shaft 3 is connected to a driving geared motor, not shown for the sake of simplicity, by means of which it is continuously or intermittently rotated, as it will become apparent from the following.

A plurality of shaped bodies 4 (FIGS. 4 to 7) are mounted along the periphery of disc 2, the bodies being equally spaced apart from one another and one end 5 of which projects from that face of disc 2 downward facing in FIG. 1 to the upper surface of the drawing in FIG. 2 and to the right in FIG. 3.

In the embodiment shown (FIGS. 4 to 7), the shaped bodies 4 are hollow and internally accomodate a cup 6, the walls and bottom of which are passed through by holes (for example, the cup is made by a wire net or the like) and the mouth or inlet of which is open to the end of the respective body 4, the walls and bottom of the cup being spaced apart from the adjacent surfaces of body 4.

At the bottom of each cup 6, a hole 7 is formed in the end of each body 4 opposite to end 5. Adjacent said end 5, an annular flange 8 projects from each body 4, which flange is cut away by a groove 9 which also furrows the outer surface of body 4, extending in a direction parallel to the axis of the body.

Figure 7:
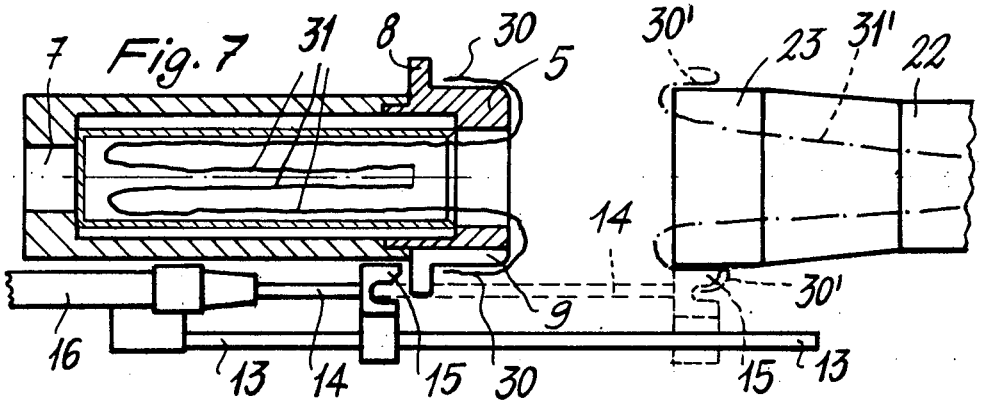
FIG. 7 is a diagrammatic view showing a shaped body of the apparatus located in front of a tube of the sewing machine as the tubular element is transferred from the shaped body to said tube.
Figure 4:
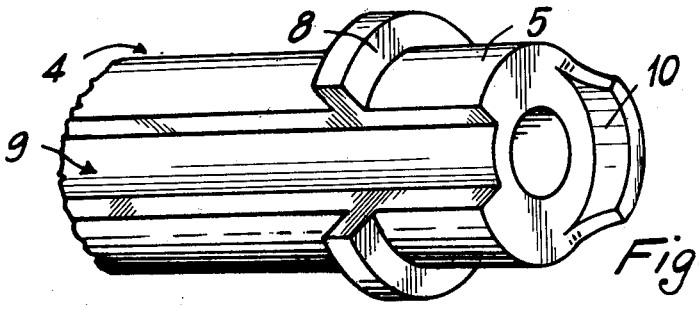
Figure 6:
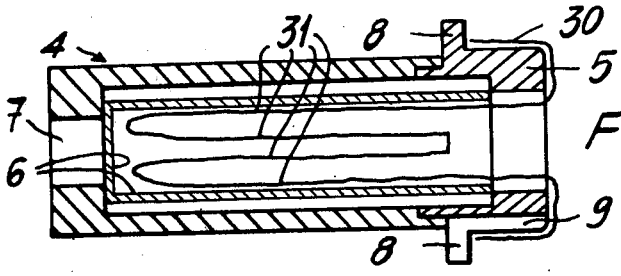
FIGS. 5 and 6 are two diagrammatic sectional views and at two subsequent operative steps of a shaped body having a tubular element of textile material applied thereon.
Figure 5:
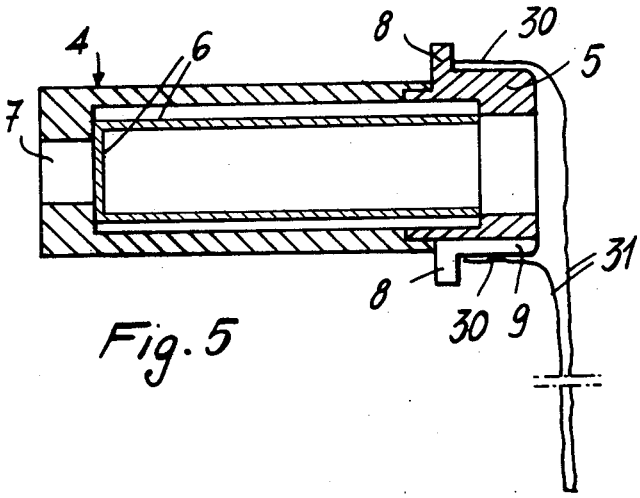
Figure 1:
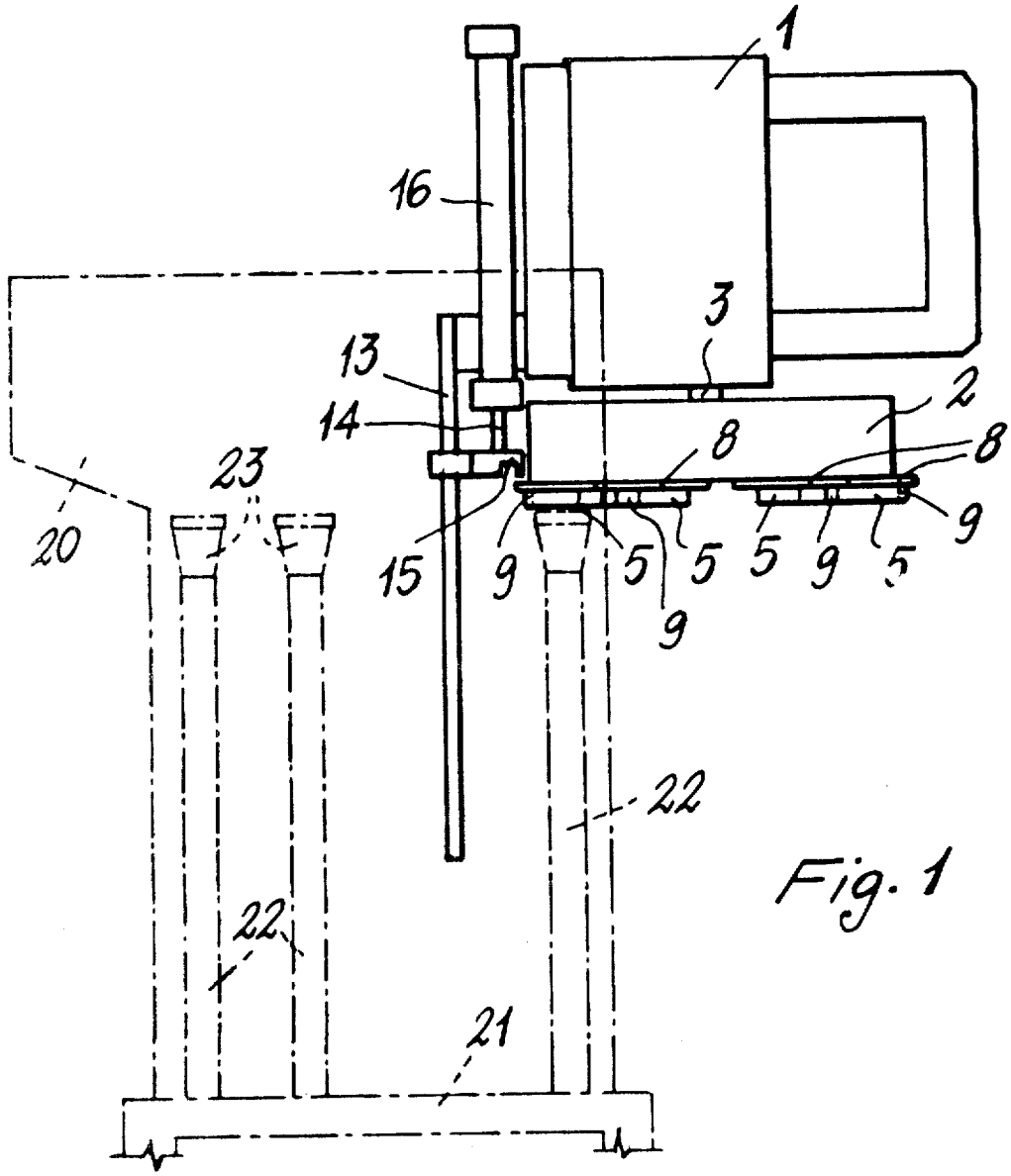
Figure 7:
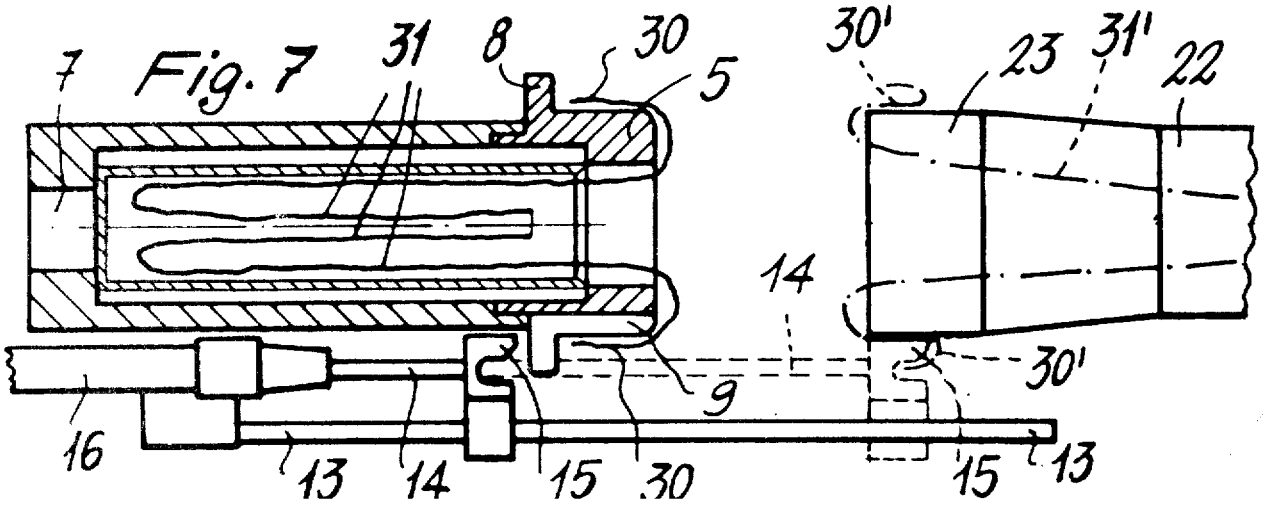
Figure 2:
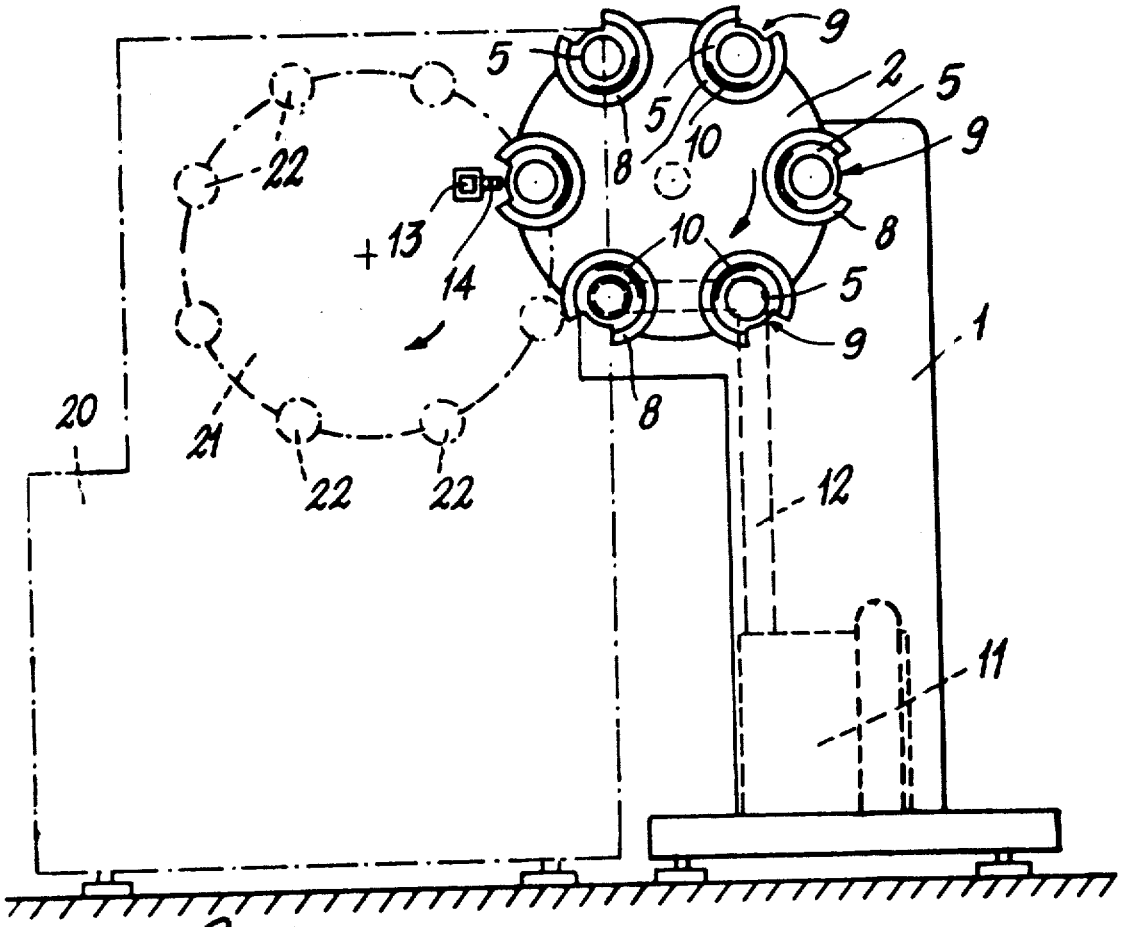
Figure 4:
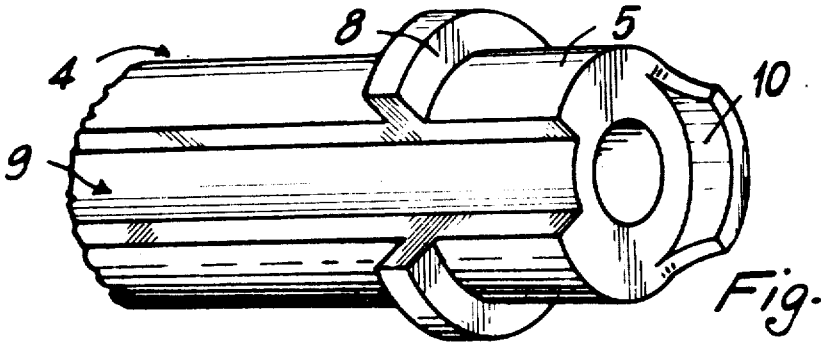
Figure 6:
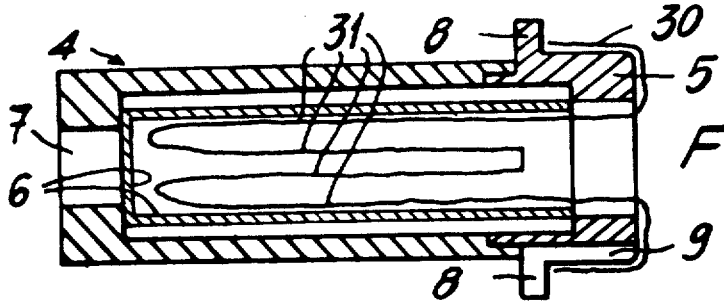
Figure 3:
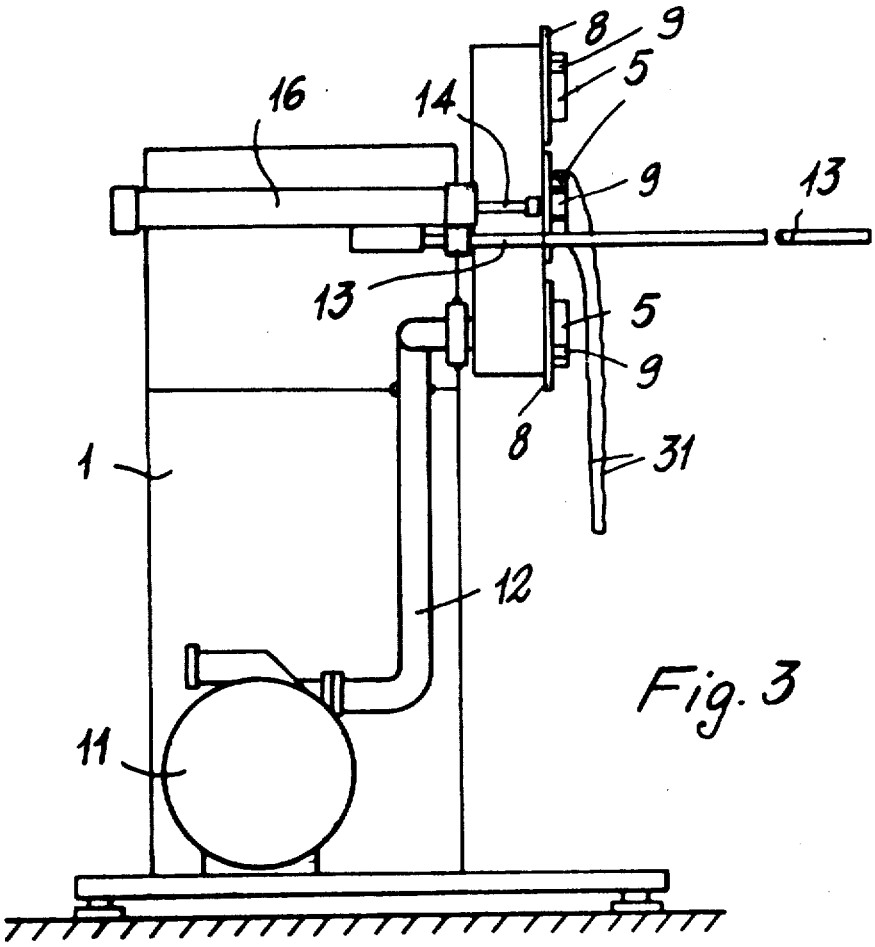
Figure 5:
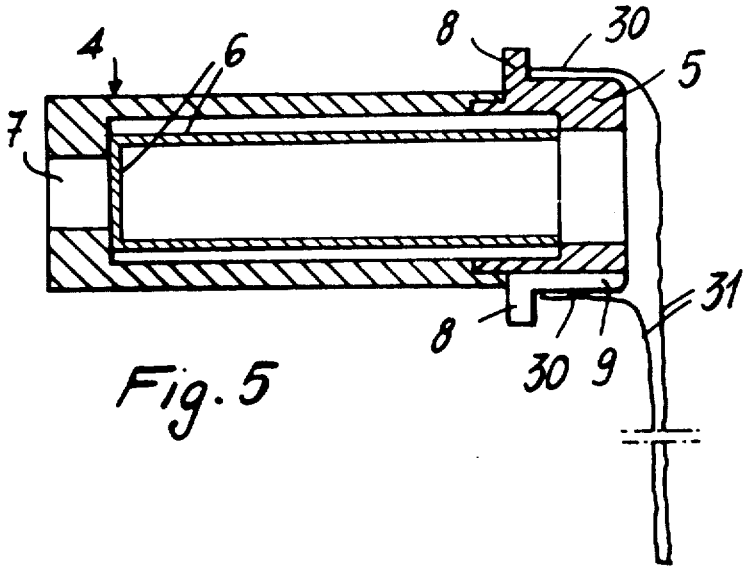

In FIG. 4 there has been shown an embodiment of body 4, in which the groove 9 extends throughout the length of body 4, but at this time it should be noted that it is only essential that such a groove would extend through the flange and on the end portion 5 of the body, that is between flange 8 and the front end of body 4: this simplified embodiment has been shown in FIGS. 5, 6 and 7.

Preferably, from the front end 5 of each body 4 there projects a tab 10 in the shape of an arc of circle (FIG. 4) which is not essential (and for this reason and simplicity not shown in FIGS. 5, 6 and 7) and which performs the function of supporting as outwardly projecting a portion of the edge of the tubular element of textile material which is carried on body 4, as it will be explained hereinafter. Bodies 4 are mounted on the apparatus so that grooves 9 are outward facing, while tab 10 will be diametrically opposite to groove 9 on each body and accordingly will always be positioned within bodies 4 on disc 2 (see FIG. 2, where for the sake of clarity both grooves 9 and tabs 10 of bodies 4 have been shown).

The apparatus also comprises a suction pump 11, the suction inlet of which is connected to a tube 12, the free end of which opens on the path of body 4 and is time by time grazed or touched lightly by the inner or rear end of each body 4, so as to be positioned through the hole 7 of said body 4 in front of the free end of tube 12 sucking air from the inside of said body 4.

The apparatus further includes a device comprising an elongate fixed rigid bar 13 extending laterally of and parallel to disc 2, continuing beyond the disc surface, from which the ends 5 of bodies 4 project, such a bar 13 slidably carrying thereon a rod 14 which at its end facing the front surface of disc 2 carries a hook 15 facing the end 5 of body 4 adjacent thereto. This hook 15 is positioned and shaped so as to be movable in groove 9 of body 4 which time by time is justaposed thereto, as particularly shown in FIG. 7.

The reciprocating motion of rod 14 is transmitted by any known means, such as by a pneumatic cylinder-piston unit 16, of which the rod 14 could be the stem. Prior to describing the operation of the apparatus, let us refer again to FIGS. 1, 2 and 7, in which by dashed line a portion of a known type of semiautomatic sewing machine has been diagrammatically shown, comprising a base 20 supporting a rotable turret 21, from which a plurality of tubes 22 project, these tubes being parallel to and spaced apart from one another and designed to receive an overturned tubular element of textile material (that is with the front surface adhering to to the surface of the mounting tube) and move and hold it under the machine sewing head to sew the tip of the stocking obtained from the tubular element.

The apparatus according to the invention is positioned in front of the sewing machine so that the path line for bodies 4 is tangent to that for tubes 22 and that, at the tangential location (FIG. 7) the free end of portion 5 of body 4 is very close to the free end 23 of tube 22 which is in front of it. Should the sewing machine drive the rotation of turrett 21 by intermittent motion, said sewing machine would be connected to the apparatus according to the invention by a very simple electric circuit (and accordingly not shown for the sake of simplicity), so that when turret 21 is stopped, the machine acts upon a microswitch causing also the driving motor of disc 2 to stop, and when turret 21 starts again, the microswitch controls the restarting of the movement also for disc 2.

Evidently, the apparatus will be positioned in front of the sewing machine so that a body 4 stops time by time exactly in front of and coaxially with one of tubes 22 that have stopped at the above mentioned tangential location. It is also evident that should turret 21 be provided with a continuous rotary motion, also disc 2 would continuously rotate, so that still of front of each tube 22 a distinct body 4 would pass.

Suppose now that the apparatus and sewing machine are correctly positioned and operating.

On the end 5 of a body 4, which is about to reach at the suction end of tube 12, a workman places (FIGS. 3 and 5) the edge 30 of a tubular element 31 of textile material, till to bring such an edge to the proximity of flange 8 (FIGS. 5, 6 and 7): said edge 30 is normally reinforced and often also elasticized, and it should be noted that the outer perimeter of end 5 of body 4 (as well as the outer perimeter of end 23 of mounting tube 22) is substantially the same as or slightly larger than the perimeter of edge 30 of tubular element 31.

It is important to point out that what has been described is the only operation that the workman has to carry out, operation which is extremely simple and fast, since the workman has only to place on the end 5 of body 4 a short length or section (30) of the tubular element which, under these conditions, is hanging down from body 4 (FIGS. 3 and 5) and with its outer surface which is that which is to remain visible in the finished stocking. Having performed this simple operation, disc 2 rotates in the direction of arrow shown in FIG. 2 and body 4 with the suspended element 31 arrives at the free end of tube 12 which, through the hole 7 of body 4, sucks air from the inside of body 4 and, as a result, draws the tubular element 31 within said body 4. Element 31 spreads against the perforated walls and bottom of cup 6, taking up the shape shown in FIGS. 6 and 7.

On continued rotation of disc 2, said body 4 will be positioned in front of the free end 23 of a mounting tube 22 of the sewing machine, as shown in FIG. 1 and on enlarged scale in FIG. 7, wherein the free ends of body 4 and tube 22 have been enlarged for more clarity of the drawing. Under these conditions and at this position the sewing machine operates a microswitch causing the supply of compressed air to the pneumatic cylinder-piston unit 16, the stem 14 of which moves to the right relative to FIGS. 3 and 7, starting from the position shown by full line in FIG. 7 to reach the position shown by dashed line and further move to the right of said dashed position. At the beginning of this displacement or movement of rod 14, the hook 15 moves in the groove 9 passing across the flange 8 and outer surface of body 4, until the crook-like end of hook 15 nests below the edge 30 of element 31.

Continuing its rightward movement, said hook 15 separates said edge 30 from the end 5 of body 4 and moves said edge on the end 23 of the adjacent tube 22. It should be pointed out that this operation is promoted by the provision of tab 10 (FIG. 4) which preferably projects from the end of each body 4 at diametrically opposite position to said groove 9. Such a tab 10, which for drawing simplicity has been shown in FIG. 7, would extend at the topmost side of said figure, till to proximity of end 23 of tube 22, and thereon would slide the topmost portion (FIG. 7) of edge 30 of element 31.

In the embodiment outlined in FIG. 7, the tube 22 is of the type in the inside of which air is sucked, so that the tubular element 31 is transferred to the inside of tube 22 (where it is shown by reference numeral 31'), while its edge (here shown by referrence numeral 30') remains hooked to said hook 15, as shown still in FIG. 7. The rod 14 along with hook 15 continues its rightward movement drawing the edge 30' to the right and pulling the element 31' out of the tube 22. This rightward movement continues until the edge 30' is caught by the usual gripping and drawing members, the sewing machine is provided with, whereupon said rod 14 leftward returns to its rest or inoperative position.

It will be readily understood that the tubular element, which is thus superimposed to tube 22, is overturned, that is to say that face which is intended to be the front or right side or face of the stocking contacts the surface of tube 22. It is also important to point out that it is not essential that bodies 4 are internally hollow (and accordingly that the suction pump 11 is provided) because, if the sewing machine is of the type in which air is sucked within the tubes 22, the tubular element 31 hanging from a body 4 could be directly drawn within that tube 22 which is about to be positioned in front of the relative body 4, before said hook 15 provides for transferring the edge 30 of the tubular element from the end 5 of body 4 to the end 23 of tube 22, in which said element 31 has been drawn. On the contrary, said bodies 4 should be hollow and air should be sucked therein as described, if air is not sucked in tubes 22.

It is apparent that bodies 4, instead of being carried by a disc, could be carried by a different supporting element, for example by a conveyor belt or by a closed ring chain: it is also apparent that an apparatus of the above described design could be used for supplying two or more sewing machines of the same type, by making suitable modifications readily effectable by those skilled in the art and therefore not described herein. In any case, it would be helpful to remind that the only operation that the workman has to perform to supply the sewing machine is that of placing a short length or section 30 of the tubular elements 31 on the ends 5 of bodies 4, without overturning such elements, with all of the advantages which are evident from the foregoing.

What I claim is:

1. An apparatus for loading tubular elements of textile material on mounting tubes in semiautomatic sewing machines for sewing one end thereof to provide finished stockings, the apparatus comprising a rotatable structure a plurality of shaped bodies carried on said rotable structure and spaced apart from one another for carrying said tubular elemens of textile material, said rotable structure having projecting from one face thereof an end of each body which on its outer surface has at least one groove parallel to the pivot axis of the rotable structure, said end of each body having a perimeter substantially as long as said end of the textile tubular elements, a device juxtaposed to said structure comprising at least one axially movable elongated rod, the free end of which when at rest in the inoperative position is clear of the path for the shaped bodies, the device including a control member causing an axial reciprocation of said rod bringing it to graze or touch lightly and then go beyond the projecting end of that shaped body which is positioned at the zone in front of said rod, a hook integral with the free end of said rod facing the projecting end of the shaped body when positioned at said zone, said hook moving in said groove of the body as the rod moves so as to engage the end of said tubular element.

2. An apparatus according to claim 1, wherein each of said shaped bodies substantially comprise an internally hollow elongated cylinder, within which a basket means is arranged with perforated side walls and bottom and with a mouth or inlet open at said projecting end of the shaped body, the other end of the body being superimposed in a fixed zone of the body path to the mouth or inlet of a conduit which is connected to a suction pump.

3. An apparatus according to claims 1 or 2, wherein said rod is parallel to and slidable on at least one elongated rigid bar which is integral with said device and clear of the path for said shaped bodies, such a bar extending beyond said projecting end of said shaped bodies.

4. An apparatus according to claim 1, wherein an annular flange also crossed by the groove passing across the outer surface of the shaped body projects from each of said shaped bodies adjacent said projecting end thereof.

* * * * *

UNITED STATES PATENT AND TRADEMARK OFFICE

CERTIFICATE OF CORRECTION

PATENT NO. : 4,196,681

DATED : April 8, 1980

INVENTOR(S) : Giovanni Chietti

It is certified that error appears in the above—identified patent and that said Letters Patent is hereby corrected as shown below:

The 3 sheets of drawings should be deleted to insert the attached sheets of drawings containing figures 1 thru 7.

Signed and Sealed this

*Twenty-ninth* Day of *July 1980*

[SEAL]

*Attest:*

SIDNEY A. DIAMOND

*Attesting Officer*

*Commissioner of Patents and Trademarks*